US010369827B2

(12) United States Patent
Chiu et al.

(10) Patent No.: US 10,369,827 B2
(45) Date of Patent: Aug. 6, 2019

(54) TRANSFER FILM

(71) Applicants: Ju-Chen Chiu, Taipei (TW); Po-An Lin, Taipei (TW); Chih-Hua Liu, Taipei (TW)

(72) Inventors: Ju-Chen Chiu, Taipei (TW); Po-An Lin, Taipei (TW); Chih-Hua Liu, Taipei (TW)

(73) Assignee: COMPAL ELECTRONICS, INC., Taipei (TW)

( * ) Notice: Subject to any disclaimer, the term of this patent is extended or adjusted under 35 U.S.C. 154(b) by 0 days.

(21) Appl. No.: 15/729,677

(22) Filed: Oct. 11, 2017

(65) Prior Publication Data

US 2019/0054750 A1 Feb. 21, 2019

(30) Foreign Application Priority Data

Aug. 18, 2017 (TW) ..... 106128085 A

(51) Int. Cl.
*B41M 5/42* (2006.01)
*B41M 7/00* (2006.01)
*B41M 5/41* (2006.01)

(52) U.S. Cl.
CPC ..... *B41M 5/42* (2013.01); *B41M 5/41* (2013.01); *B41M 7/0054* (2013.01)

(58) Field of Classification Search
CPC ... B44C 1/17; Y10T 428/28; Y10T 428/2848; Y10T 428/24364; Y10T 428/24521; Y10T 428/2457
See application file for complete search history.

(56) References Cited

U.S. PATENT DOCUMENTS

2010/0104807 A1* 4/2010 Chiu ..... B44C 1/17 428/142
2012/0196065 A1* 8/2012 Chen ..... B32B 33/00 428/36.4

FOREIGN PATENT DOCUMENTS

| | | |
|---|---|---|
| CN | 101439624 | 5/2009 |
| TW | 201016482 | 5/2010 |
| TW | 201016483 | 5/2010 |
| TW | I365812 | 6/2012 |

OTHER PUBLICATIONS

"Office Action of Taiwan Counterpart Application," dated Aug. 2, 2018, pp. 1-6.

* cited by examiner

*Primary Examiner* — Betelhem Shewareged
(74) *Attorney, Agent, or Firm* — JCIPRNET

(57) ABSTRACT

A transfer film including a substrate, a protection layer, a metal coating layer, and an ink layer is provided. The substrate has a first surface and a second surface, and the first surface has a first stereoscopic pattern. The protection layer is disposed on the substrate, and has a third surface and a fourth surface. The third surface contacts the first surface, and has a second stereoscopic pattern complementing the first stereoscopic pattern. The fourth surface has a third stereoscopic pattern. The metal coating layer is disposed on the protection layer, and has a fifth surface contacting the fourth surface and a sixth surface. The ink layer is disposed on the metal coating layer. The protection layer and the substrate are separated after transfer to expose the second stereoscopic pattern and reflect out the third stereoscopic pattern. A manufacturing method of the transfer film is also provided.

7 Claims, 4 Drawing Sheets

TRANSFER FILM

CROSS-REFERENCE TO RELATED APPLICATION

This application claims the priority benefit of Taiwan application serial no. 106128085, filed on Aug. 18, 2017. The entirety of the above-mentioned patent application is hereby incorporated by reference herein and made a part of this specification.

BACKGROUND OF THE INVENTION

Field of the Invention

The invention relates to a film and a manufacturing method thereof, and more particularly relates to a transfer film and a manufacturing method thereof.

Description of Related Art

Currently, the thermal transfer technology usually utilizes a transfer film to thermally transfer an ink layer onto the surface of a product. Since the ink layer transferred onto the product is directly exposed, it may be easily damaged or destroyed by an external force or a foreign object. In order to protect the ink layer, a protection layer needs to be applied on the ink layer. However, application of the protection layer would increase the manufacturing processes and time. In addition, for a product that has a stereoscopic pattern thereon (for example, an ink layer that forms a stereoscopic pattern may be disposed on the surface of the product), the protection layer may flatten the surface and eliminate the texture of the stereoscopic pattern.

SUMMARY OF THE INVENTION

The invention provides a transfer film, which creates a special texture and visual experience.

The invention provides a manufacturing method of the transfer film for reducing the manufacturing processes and time.

The transfer film of the invention includes a substrate, a protection layer, a metal coating layer, and an ink layer. The substrate has a first surface and a second surface opposite to each other, and the first surface has a first stereoscopic pattern. The protection layer is disposed on the first surface of the substrate. The protection layer has a third surface and a fourth surface opposite to each other, wherein the third surface is in contact with the first surface and has a second stereoscopic pattern complementing the first stereoscopic pattern. The fourth surface has a third stereoscopic pattern. The metal coating layer is disposed on the fourth surface of the protection layer, wherein the metal coating layer has a fifth surface and a sixth surface opposite to each other, and the fifth surface is in contact with the fourth surface. The ink layer is disposed on the sixth surface of the metal coating layer, wherein the protection layer and the substrate are separated after transfer to expose the second stereoscopic pattern and reflect out the third stereoscopic pattern.

According to an embodiment of the invention, the transfer film further includes an adhesive layer disposed on the ink layer, and the metal coating layer and the adhesive layer are respectively located on two opposite sides of the ink layer.

According to an embodiment of the invention, the fifth surface includes a fourth stereoscopic pattern complementing the third stereoscopic pattern, and the sixth surface includes a fifth stereoscopic pattern that is conformal with the fourth stereoscopic pattern.

According to an embodiment of the invention, the ink layer has a seventh surface that is in contact with the sixth surface, and the seventh surface includes a sixth stereoscopic pattern complementing the fifth stereoscopic pattern.

According to an embodiment of the invention, the protection layer is a transparent protection layer configured to allow a light to pass through and reflect out the light that reaches a junction between the fourth surface and the fifth surface.

According to an embodiment of the invention, the metal coating layer is a translucent metal coating layer.

According to an embodiment of the invention, a light transmittance of the metal coating layer is in a range of 30% to 80%.

The manufacturing method of the transfer film of the invention includes the following. A substrate is provided, which has a first surface and a second surface opposite to each other, and the first surface includes a first stereoscopic pattern. A protection layer is formed on the first surface of the substrate. The protection layer has a third surface and a fourth surface opposite to each other, wherein the third surface is in contact with the first surface to form a second stereoscopic pattern complementing the first stereoscopic pattern, and the fourth surface includes a third stereoscopic pattern. A metal coating layer is formed on the fourth surface of the protection layer, wherein the metal coating layer has a fifth surface and a sixth surface opposite to each other, and the fifth surface is in contact with the fourth surface. An ink layer is formed on the sixth surface of the metal coating layer, wherein the protection layer and the substrate are separated after transfer, so as to expose the second stereoscopic pattern and reflect out the third stereoscopic pattern.

According to an embodiment of the invention, the manufacturing method of the transfer film further includes: forming an adhesive layer on the ink layer, wherein the metal coating layer and the adhesive layer are respectively located on two opposite sides of the ink layer.

According to an embodiment of the invention, when the metal coating layer is formed on the fourth surface of the protection layer, the fifth surface forms a fourth stereoscopic pattern complementing the third stereoscopic pattern, and the sixth surface forms a fifth stereoscopic pattern that is conformal with the fourth stereoscopic pattern.

According to an embodiment of the invention, the ink layer has a seventh surface that is in contact with the sixth surface, and when the ink layer is formed on the sixth surface of the metal coating layer, the seventh surface forms a sixth stereoscopic pattern complementing the fifth stereoscopic pattern.

According to an embodiment of the invention, the manufacturing method of the transfer film further includes: performing a stereoscopic texture process on the fourth surface of the protection layer to form the third stereoscopic pattern.

Based on the above, the manufacturing method of the transfer film of the invention may be performed to form a stereoscopic pattern directly on the protection layer, so as to reduce the manufacturing processes and time. Moreover, the protection layer and the substrate of the transfer film are separated after the transfer and the second stereoscopic pattern is exposed to the outside, so as to create a special texture for the user. In addition, the user may see both the second stereoscopic pattern on the outside and the third stereoscopic pattern on the inside, so as to obtain special visual experience.

To make the aforementioned and other features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain the principles of the invention.

DESCRIPTION OF THE EMBODIMENTS

FIG. 1 to FIG. 5 are schematic cross-sectional views showing a manufacturing method of a transfer film according to an embodiment of the invention. It should be noted that, for clarity and ease of explanation, the thickness of each layer in FIG. 1 to FIG. 5 or the ratio of the layers may not be drawn to scale and thus it should not be interpreted as the actual thickness or ratio of the layers. First, referring to FIG. 1, a substrate 11 is provided, which has a first surface 11*a* and a second surface 11*b* opposite to each other, and the first surface 11*a* has a first stereoscopic pattern 11*c*. More specifically, the substrate 11 is a metal film such as aluminum and copper; a resin film such as acrylic resin, polyester, polystyrene (PS), polyvinyl chloride (PVC), polyethylene (PE), polypropylene (PP), polyolefin (PO), polycarbonate (PC), and polyurethane (PU); or a cellulose film such as paper, for example. An uneven texture structure is formed on one of the flat surfaces of the substrate 11 by printing, imprinting, scribing, or brushing, so as to form the first surface 11*a* having the first stereoscopic pattern 11*c*.

Then, a protection layer 12 is Ruined on the first surface 11*a*, and a material thereof may include a thermosetting resin, a radiation curable resin, and an electron beam curable resin. The thermosetting resin may be an acrylic-based resin, an acrylic polyol based resin, a vinyl-based resin, a polyester-based resin, an epoxy-based resin, or a polyurethane-based resin. The radiation curable resin and the electron beam curable resin may include a monomer and an oligomer, wherein the monomer may be methacrylate-based, acrylate-based, vinyl-based, vinyl-ether based, or epoxy-based, which has a monofunctional group, a bifunctional group, or a polyfunctional group; and the oligomer may be unsaturated polyester-based, epoxy acrylate-based, polyurethane acrylate-based, polyester acrylate-based, polyether acrylate-based, an acrylated acrylic oligomer, or an epoxy-based resin. For example, a colloid obtained by using at least one of the foregoing materials may be applied on the first surface 11*a* and then the colloid is cured to form the protection layer 12, which is a transparent protection layer.

Figure 1:
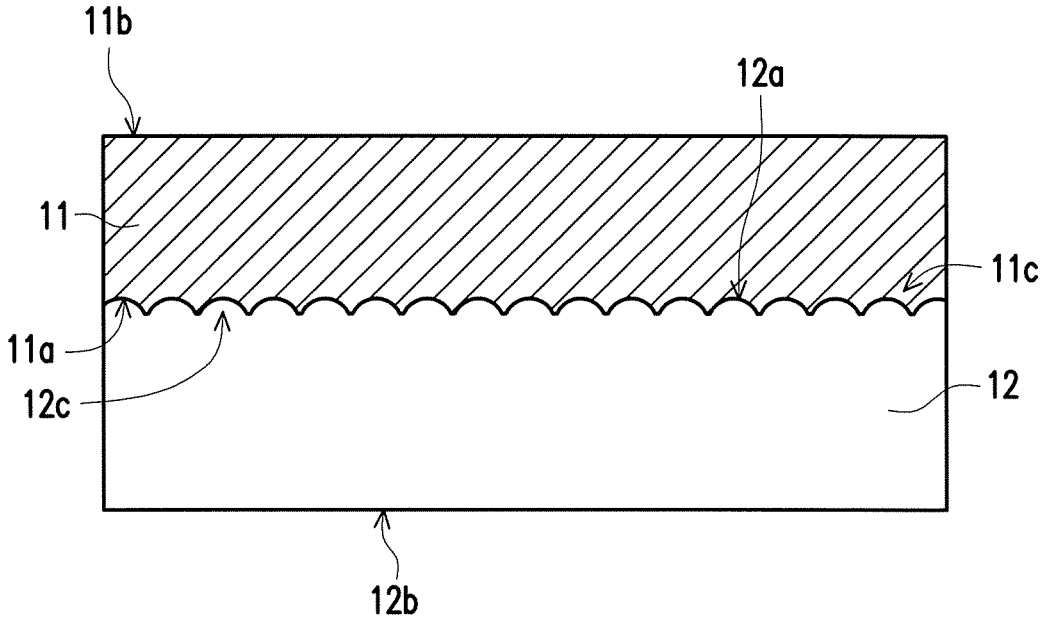
FIG. 1 to FIG. 5 are schematic cross-sectional views showing a manufacturing method of a transfer film according to an embodiment of the invention.
Figure 2:
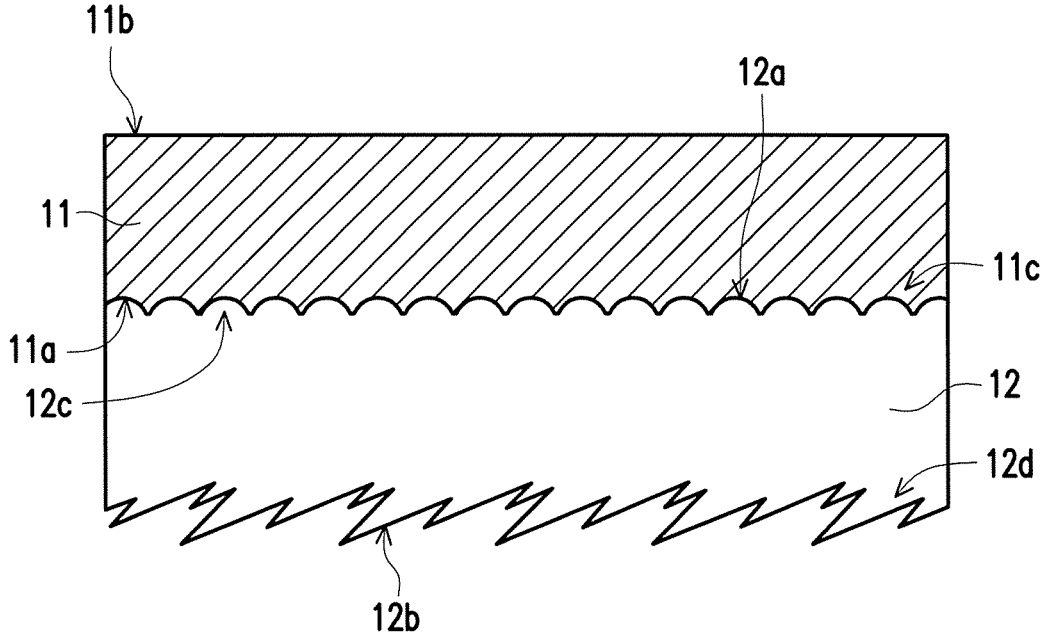

The protection layer 12 has a third surface 12*a* and a fourth surface 12*b* opposite to each other, wherein the third surface 12*a* is in contact with the first surface 11*a* (or the third surface 12*a* covers the first surface 11*a*) to form a second stereoscopic pattern 12*c* complementing the first stereoscopic pattern 11*c*, and the fourth surface 12*b* has a third stereoscopic pattern 12*d*. In the case where the second stereoscopic pattern 12*c* is formed directly on the protection layer 12, the manufacturing processes and time are reduced. More specifically, the fourth surface 12*b* before being processed by a stereoscopic texture process (e.g., printing, imprinting, scribing, or brushing) is a flat surface (as shown in FIG. 1), and then the stereoscopic texture process (e.g., printing, imprinting, scribing, or brushing) is performed on the fourth surface 12*b* to form the third stereoscopic pattern 12*d*, wherein a geometrical contour of the first stereoscopic pattern 11*c* and a geometrical contour of the second stereoscopic pattern 12*c* are completely different from a geometrical contour of the third stereoscopic pattern 12*d*, as shown in FIG. 2.

Figure 3:
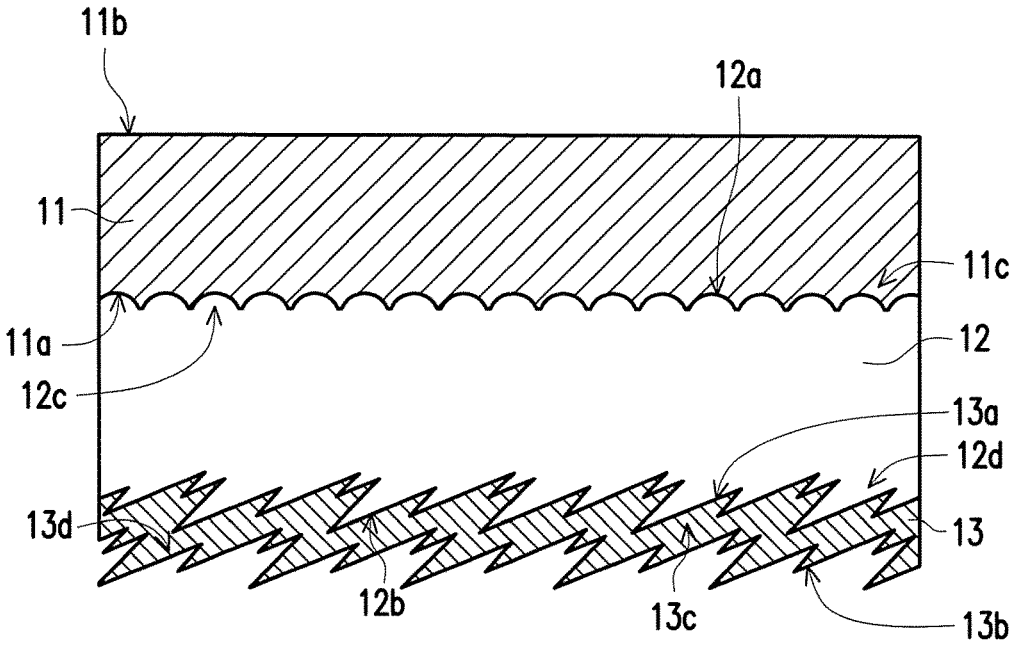

Thereafter, referring to FIG. 3, a metal coating layer 13 is formed on the fourth surface 12*b* of the protection layer 12 by a physical method (e.g., sputtering or evaporation) or a chemical method (e.g., solution deposition), which is a translucent metal coating layer having a light transmittance in a range of about 30% to 80%. The metal coating layer 13 may be a nano thin layer, which has a fifth surface 13*a* and a sixth surface 13*b* opposite to each other. The fifth surface 13*a* is in contact with the fourth surface 12*b* (or the fifth surface 13*a* covers the fourth surface 12*b*) to form a fourth stereoscopic pattern 13*c* complementing the third stereoscopic pattern 12*d*, and the sixth surface 13*b* forms a fifth stereoscopic pattern 13*d*, and the fourth stereoscopic pattern 13*c* and the fifth stereoscopic pattern 13*d* are conformal.

Figure 4:
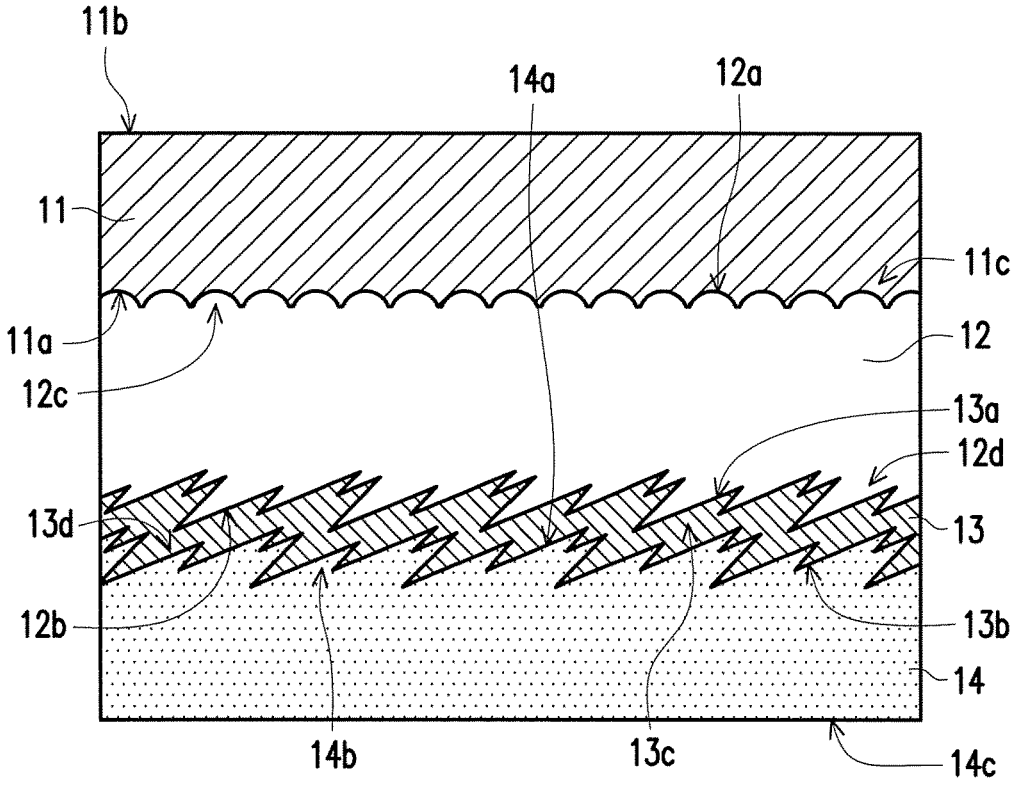

Then, referring to FIG. 4, an ink layer 14 is formed on the sixth surface 13*b* of the metal coating layer 13 by inkjet or printing. The ink layer 14 has a seventh surface 14*a* that in contact with the sixth surface 13*b* (or the seventh surface 14*a* covers the sixth surface 13*b*), and when the ink layer 14 is formed on the sixth surface 13*b* of the metal coating layer 13, the seventh surface 14*a* forms a sixth stereoscopic pattern 14*b* complementing the fifth stereoscopic pattern 13*d*. In the ink layer 14, an eighth surface 14*c* opposite to the seventh surface 14*a* may be a flat surface. At last, an adhesive layer 15 is formed on the eighth surface 14*c* of the ink layer 14, and the metal coating layer 13 and the adhesive layer 15 are respectively located on two opposite sides of the ink layer 14. A material of the adhesive layer 15 is an acrylic-based resin, a urethane-based resin, a vinyl-based resin, a polyester-based resin, a polystyrene-based resin, a polypropylene-based resin, a polyethylene-based resin, or a polycarbonate-based resin, for example, for enhancing adhesion of the transfer film 10.

Figure 5:
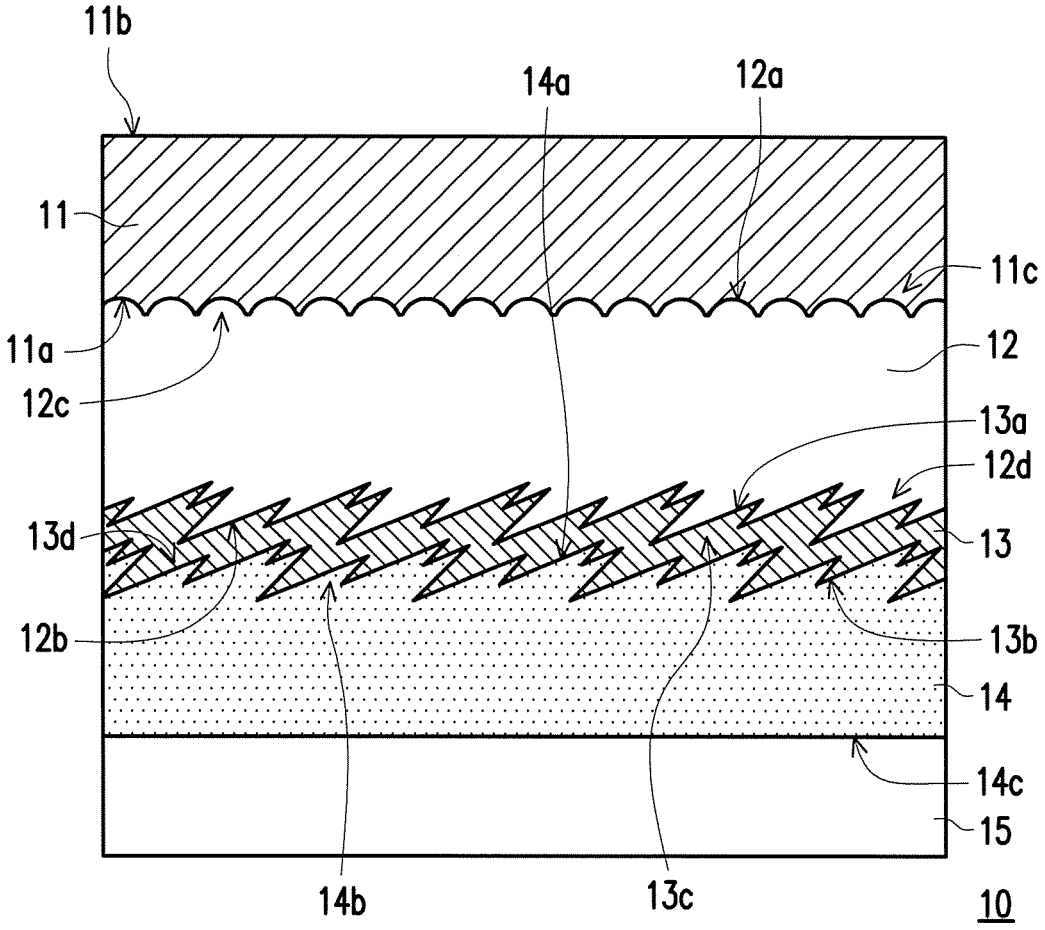
Figure 6:
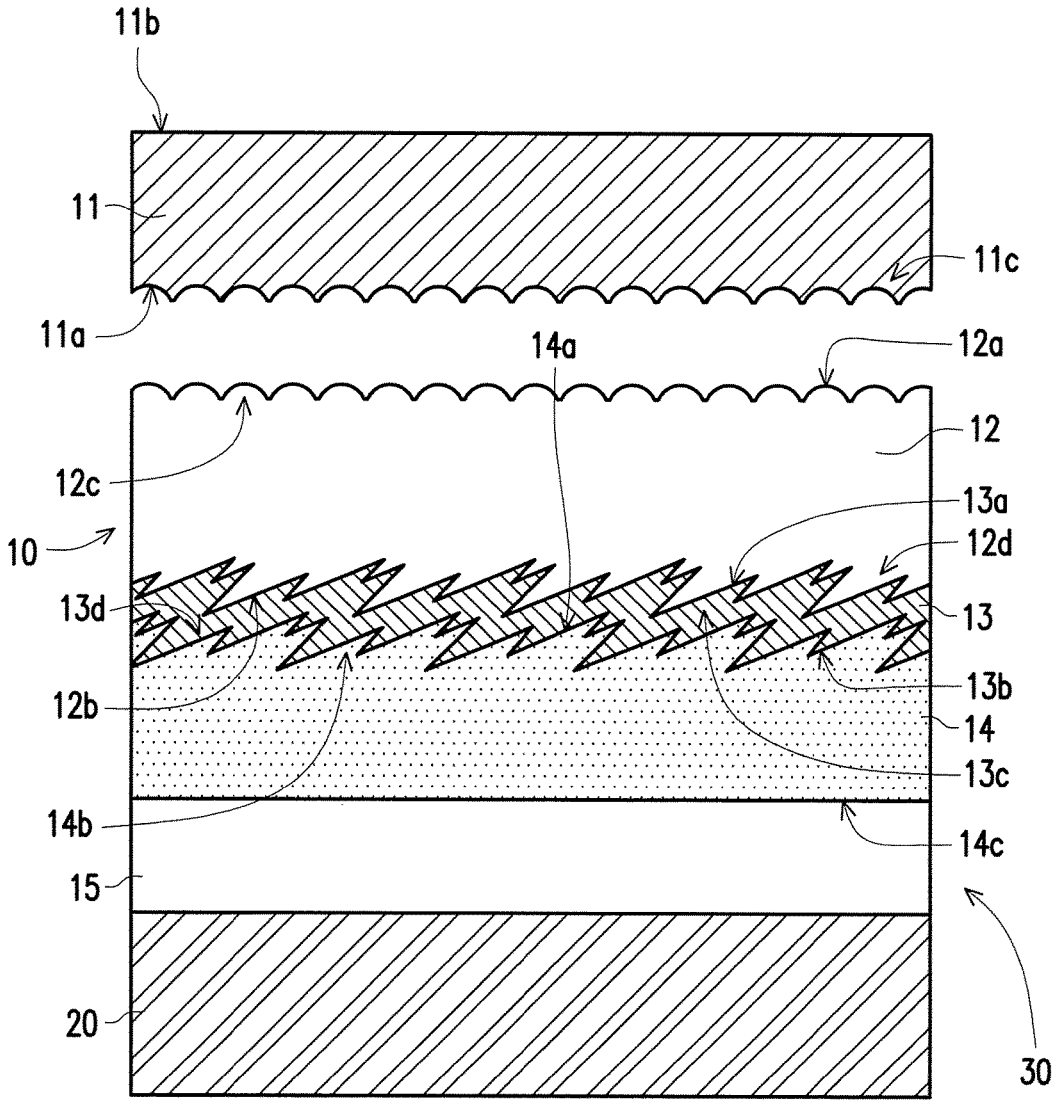
FIG. 6 is a schematic cross-sectional view of a target object with the transfer film of FIG. 5.

FIG. 6 is a schematic cross-sectional view of a target object with the transfer film of FIG. 5. It should be noted that, for clarity and ease of explanation, the thickness of each layer in FIG. 6 or the ratio of the layers may not be drawn to scale and thus it should not be interpreted as the actual thickness or ratio of the layers. Referring to FIG. 6, the transfer film 10 is attached to a target object 20 (e.g., a housing of an electronic device) by the adhesive layer 15, and then pressure or heat is applied on the substrate 11 to adhere the transfer film 10 to the target object 20 through the adhesive layer 15. At last, the substrate 11 is removed, that is, the protection layer 12 and the substrate 11 are separated after the transfer, so as to expose the second stereoscopic pattern 12*c*. Thus, the user may feel a special texture when touching an outer surface (i.e., the third surface 12*a* of the protection layer 12) of a target object surface structure 30, as shown in FIG. 6. In other embodiments, the transfer film may not include the adhesive layer. In that case, the adhesive layer is formed on the target object for adhesion to the transfer film only when the transfer film is transferred onto the target object.

In this embodiment, the protection layer 12 is a transparent protection layer. Therefore, light is allowed to pass through the transparent protection layer to be projected to a junction between the fourth surface 12*b* and the fifth surface 13*a* and be reflected at the junction between the fourth surface 12*b* and the fifth surface 13*a* to pass through the transparent protection layer to be projected to the outside, such that the user is able to see the third stereoscopic pattern 12*d* inside the target object surface structure 30. In the meantime, the user is able to see the second stereoscopic pattern 12*c* on the outside of the target object surface structure 30. The combination of the different geometrical contours of the second stereoscopic pattern 12*c* and the third stereoscopic pattern 12*d* creates special visual experience for the user. Furthermore, the metal coating layer 13 is disposed between the protection layer 12 and the ink layer 14, wherein the ink layer 14 is opaque, and the light transmittance of the metal coating layer 13 is about 30% to 80%. Therefore, after the light passes through the protection layer 12, in addition to being directly reflected at the junction between the fourth surface 12*b* and the fifth surface 13*a* to pass through the protection layer 12 to be projected to the outside, the light may also pass through the metal coating layer 13 to be projected to a junction between the sixth surface 13*b* and the seventh surface 14*a* and be reflected at the junction between the sixth surface 13*b* and the seventh surface 14*a* to sequentially pass through the metal coating layer 13 and the protection layer 12 to be projected to the outside, such that the user is able to see the color of the ink layer 14 inside the target object surface structure 30.

To sum up, the manufacturing method of the transfer film of the invention may be performed to form a stereoscopic pattern directly on the protection layer, so as to reduce the manufacturing processes and time. Moreover, in the transfer film, the second stereoscopic pattern on one of the surfaces of the protection layer is different from the third stereoscopic pattern on the other surface. The protection layer and the substrate are separated after the transfer and the second stereoscopic pattern is exposed to the outside, so as to create a special texture for the user. Furthermore, the protection layer is a transparent protection layer. Therefore, light is allowed to pass through the transparent protection layer to be projected to the junction between the fourth surface and the fifth surface and be reflected at the junction between the fourth surface and the fifth surface to pass through the transparent protection layer to be projected to the outside, such that the user is able to see the third stereoscopic pattern inside. In the meantime, the user is able to see the second stereoscopic pattern on the outside. The combination of the different geometrical contours of the second stereoscopic pattern and the third stereoscopic pattern creates special visual experience for the user.

It will be apparent to those skilled in the art that various modifications and variations can be made to the disclosed embodiments without departing from the scope or spirit of the invention. In view of the foregoing, it is intended that the invention covers modifications and variations of this disclosure provided that they fall within the scope of the following claims and their equivalents.

What is claimed is:

1. A transfer film, comprising:

a substrate, having a first surface and a second surface opposite to each other, wherein the first surface comprises a first stereoscopic pattern;

a protection layer, disposed on the first surface of the substrate and having a third surface and a fourth surface opposite to each other, wherein the third surface is in contact with the first surface and comprises a second stereoscopic pattern complementing the first stereoscopic pattern, and the fourth surface comprises a third stereoscopic pattern;

a metal coating layer, disposed on the fourth surface of the protection layer and having a fifth surface and a sixth surface opposite to each other, wherein the fifth surface is in contact with the fourth surface; and an ink layer, disposed on the sixth surface of the metal coating layer, wherein the protection layer and the substrate are separated after transfer, so as to expose the second stereoscopic pattern and reflect out the third stereoscopic pattern, wherein a geometrical contour of the second stereoscopic pattern is different from a geometrical contour of the third stereoscopic pattern.

2. The transfer film according to claim 1, further comprising:

an adhesive layer, disposed on the ink layer, wherein the metal coating layer and the adhesive layer are respectively located on two opposite sides of the ink layer.

3. The transfer film according to claim 1, wherein the fifth surface comprises a fourth stereoscopic pattern complementing the third stereoscopic pattern, and the sixth surface comprises a fifth stereoscopic pattern that is conformal with the fourth stereoscopic pattern.

4. The transfer film according to claim 3, wherein the ink layer has a seventh surface that is in contact with the sixth surface, and the seventh surface comprises a sixth stereoscopic pattern complementing the fifth stereoscopic pattern.

5. The transfer film according to claim 1, wherein the protection layer is a transparent protection layer configured to allow a light to pass through and reflect out the light that reaches a junction between the fourth surface and the fifth surface.

6. The transfer film according to claim 1, wherein the metal coating layer is a translucent metal coating layer.

7. The transfer film according to claim 6, wherein a light transmittance of the metal coating layer is in a range of 30% to 80%.

* * * * *